United States Patent [19]

Tihonovich

[11] Patent Number: 4,513,760

[45] Date of Patent: Apr. 30, 1985

[54] HINGED HAIR CURLING ROLLER

[76] Inventor: Walter Tihonovich, 1330 Pine, Pueblo, Colo. 81004

[21] Appl. No.: 163,927

[22] Filed: Jun. 27, 1980

[51] Int. Cl.[3] ..... A45D 2/00

[52] U.S. Cl. ..... 132/40; 132/42 R

[58] Field of Search ..... 132/40, 41, 42

[56] References Cited

U.S. PATENT DOCUMENTS 1,455,696 5/1923 Wright .
2,809,644 10/1957 Carey ..... 132/42 R
2,809,645 10/1957 Franes et al. ..... 132/42 R
2,809,646 10/1957 Solomon ..... 132/42 R
2,828,753 4/1958 Pileggi et al. ..... 132/42 R

*Primary Examiner*—Gregory E. McNeill
*Attorney, Agent, or Firm*—Richard W. Hanes

[57] ABSTRACT

A hair curling roller having a pair of openable jaws which have reciprocally related, undulating, interfacing surfaces and cooperatingly contoured outside surfaces forming a circular or eliptical roller body with a hinge interconnecting the two jaws in order that the jaws may be open to receive and clamp a lock of hair.

4 Claims, 9 Drawing Figures

Fig. 1
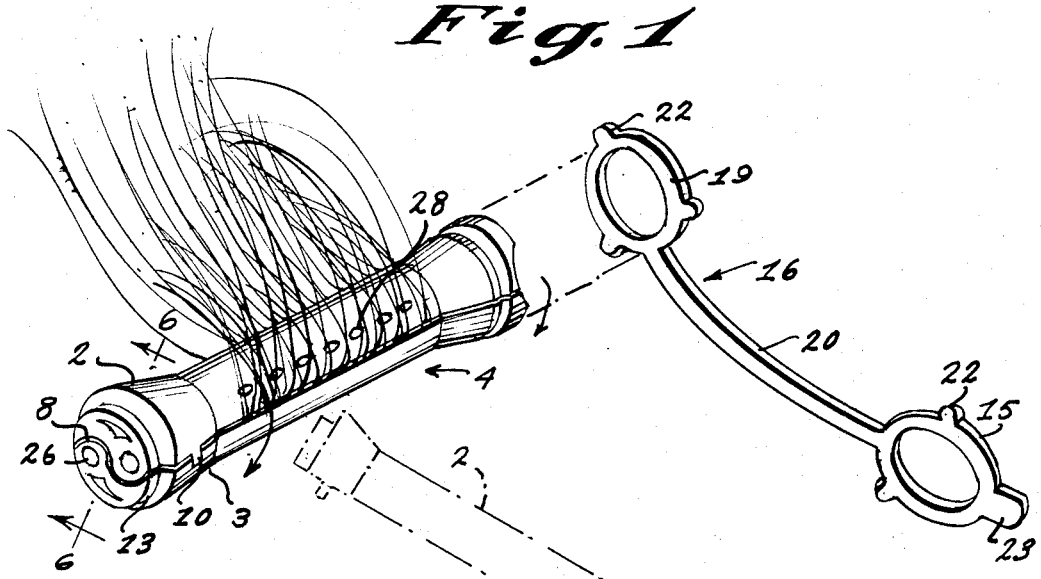
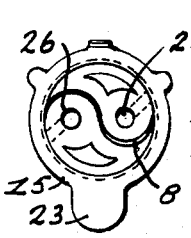
Fig. 3
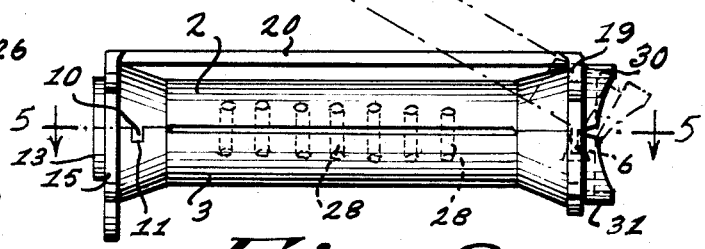
Fig. 2
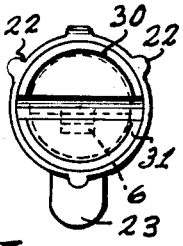
Fig. 4
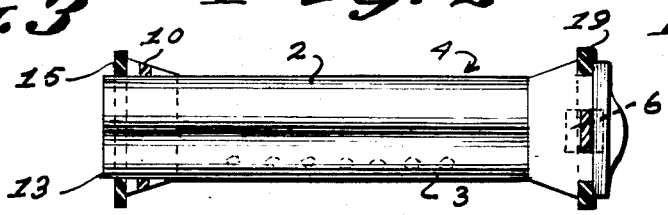
Fig. 5
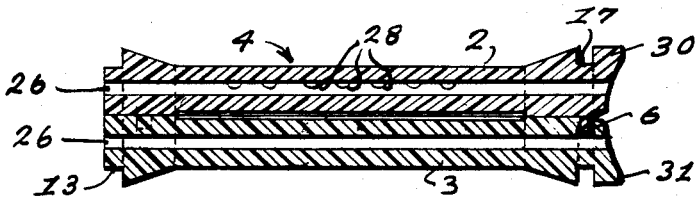
Fig. 6
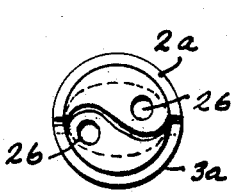
Fig. 8
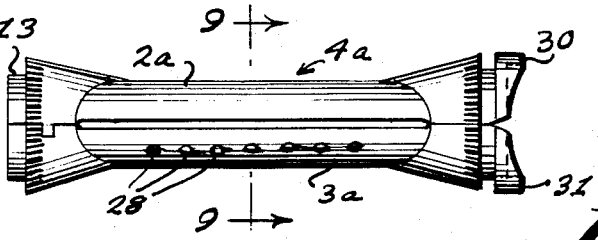
Fig. 7
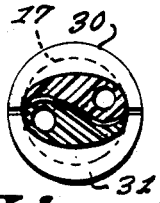
Fig. 9

HINGED HAIR CURLING ROLLER

BACKGROUND OF THE INVENTION

A variety of hair curling rollers have been developed and used, however there has been a common problem with all such apparatus in their methods of securing the free ends of a tress to the roller before beginning to roll the hair into an obvolute form upon the tubular roller. Some rollers employ clamps for this purpose, but the objection to this method is that the hair which is between the clamping jaws does not receive the same curling stress as the remaining length of hair in the lock and sharp bends around the edges of the clamping members tend to break the hair or put an undesireable and non-uniform kink in the hair at the point of contact with the clamping edge.

A further disadvantage of prior art hair rollers involves the difficulty of grasping all the hair strands in a lock of hair because the strands are of different lengths. If the roller is placed near the end of the longer strands, the shorter ones are missed and do not get clamped and are not properly rolled or may not be rolled at all. Placing the roller closer to the scalp to catch the shorter strands produces a king or wrinkle near the end of the longer strands. In order to solve this problem, some methods of hair rolling use paper or pieces of wool to wrap the end of a lock and thus secure all or most all the hair ends. The main disadvantage of this system is that the hair ends are folded and the hair is easily bunched under the wrap instead of laying flat on the curling roller. The folded hair ends produce "fishhooks" and the paper or wool greatly increases the diameter of the roll, giving uneven curls.

The primary object of the present invention is to provide a hair curling roller which will obviate the aforementioned problems by curling the hair between a pair of clamping jaws which eliminate the need for rolling papers or wool.

A second object of the invention is to provide mating surfaces between the clamping jaws of a hair roller which will not only induce curling to the hair therebetween, but will eliminate the abrupt edges and rapid change of curvature between the face of the clamping jaw and the outside circumference of the roller body.

A further object of the invention is to provide a hair curling roller which is especially adapted for permanent waving of the hair and the rapid and uniform accommodation of liquid hair curling solutions.

Another object of the invention is to provide a hair roller which may clamp the hair lock intermediate its length with no requirement that the roll be started at the free end of the lock of hair.

A still further object of the invention is to provide a roller body which will accommodate an elastic fastener to hold the roller in place after the lock has been convoluted to whatever extent desired. In rollers where the fastening device is integral with the roller body, the fastening operation may be accomplished only during one specific radial position of the roller in an entire revolution, placing the roller uncomfortably close and tight to the scalp or undesireably far away from the scalp and omitting part of the lock from the curling inducing convolution.

Another object of the invention is to provide a combination roller and hair fastener which will not tend to deform and imprint the hair which is in contact with the fastener.

Other and still further objects, features and advantages of the permanent hair curling roller of the present invention will become obvious from a reading of the following detailed description of a preferred form of the present invention, taken in connection with the accompanying drawings.

DESCRIPTION OF THE INVENTION

A hair curling roller according to the present invention is illustrated in the accompanying figures wherein:

FIG. 1 is a perspective view of the hair curling roller of the present invention showing an intermediate portion of a tress positioned between the clamping jaws of the roller. From this position, the roller would be rotated in a clockwise direction to establish convolutions of the hair. Also shown in the drawing in an exploded type of format is the elastic fastener which is used to fasten the roller in place at the completion of the rolling operation.

FIG. 2 is a side view of the roller of the present invention with one of the halves or clamping jaws shown by phantom lines in open position.

FIG. 3 is an end view of the unhinged end of the roller with the elastic fastener in place over the small diameter end of the roller.

FIG. 4 is an end view of the roller looking from the hinged end.

FIG. 5 is a cross sectional view of the roller taken along lines 5—5 of FIG. 2 and showing the undulating intersurface of the bottom half of the roller.

FIG. 6 is a cross sectional view of the roller taken along lines 6—6 of FIG. 1.

FIG. 7 is a side view of an alternative form of the roller of the present invention.

FIG. 8 is an end view of the alternative form of roller shown in FIG. 7.

FIG. 9 is a cross sectional view of the alternative form of roller taken along lines 9—9 of FIG. 7.

The preferred form of the invention comprises a pair of hinged together roller halves 2 and 3 which, when in the closed position, form a circular rod or curler 4 around which hair is wound for a period of time in order to change the shape of the hairs to influence them to curl. The curler halves 2 and 3 may be hinged together with a variety of state of the art molded hinges intended for plastic pieces. The hinge 6 shown in the drawing is a stem toggle type, however ball and socket, split socket or a pressure detent type of hinge might also be used.

One of the primary elements of novelty and improvement in the curler of the present invention is found in the shape of the mating faces of the two curler halves 2 and 3. As seen especially in FIGS. 1 and 3, each of the halves has, in cross section, a substantially curved tear drop shape reciprocally integrating with the other half to form a circumferentially circularly shaped rod on which the hair is convoluted. The parting line 8 between the interfacing surfaces of the two halves forms a surpentine or "S" shape. The reciprocally integrating halves which give an "S" shape to the interacting faces of the hair clamping jaws 2 and 3 provides curling to the hair held between the clamping members. As noted earlier as one of the objects of the invention, the "S" shaped parting line is designed and constructed so that the ends of the "S" approach the surface circumference of the roller as close to tangentially as reasonable molding or construction technique will allow. Thus, as seen in FIG. 3, if the hair is rolled onto the roller in a counterclockwise direction there is a minimal edge presented to the hair as it emerges from between the jaws 2 and 3, avoiding the bend of kink which might result from a sharper edge.

After the lock of hair is placed between the open halves (as shown by phantom lines in FIG. 2), the halves are closed into a securing position at approximately the mid-point of the hair length and locked together. The locking action is accomplished by a snap-fit pin and detent, 10 and 11 respectively, which are located near the ends of the roller halves away from the hinged ends. It will be seen that as the roller is rotated in the counter-clockwise direction, the hair above and the hair below the roller will be simultaneously wound on the roller and the diameter of the roll will not change substantially, giving a uniform curl to the full length of the tress. The surpentine shape of the interfacing jaws gives curl to the hair in the mid-portion of the lock where the roller is clamped.

The shape of each of the roller halves is so constructed that at the unhinged end, when the roller is closed, there is formed a reduced diameter end portion constituting a boss 13 around which the annular end 15 of an elastic fastener 16 may be placed. On the hinged end of the roller, the halves are appropriately constructed to form a circumferential groove 17 into which fits an elastic ring 19. The ring 19 and the annular end portion 15 are interconnected with an elastic band 20. When the lock of hair has been rolled upon the curler body, the fastener 16 is put in place, as shown in FIG. 2, and the band 20 will hold the hair roller in the position that is desired, that is, as close to or as far from the scalp as may be desired. The ring ends of the fastener 16 preferably are provided with nubs 22 and a tab 23 to facilitate handling and fastening.

When the roller is used in connection with permanent waving of the hair where chemical solutions are applied, it is necessary to provide means for the solution to contact the hair substantially uniformly around the curling roller. For this purpose, a longitudinally bore 26 is placed in each of the curler halves and each of these bores is made to communicate with a plurality of laterally extending openings 28 which communicate with the circumference of the roller. Waving solution can then be introduced into the bores 26 and be spread uniformly to the hair which is on the inside of the roll. Application of the waving solution can also be made in the normal fashion to the hair on the outside of the roll.

At the hinged end of the roller, each of the halves 2 and 3 are preferrably provided with protrubing finger and thumb holds 30 and 31 in order to facilitate opening the roller with one hand.

An alternative embodiment of the roller 4*a* is shown in FIGS. 7, 8 and 9. Instead of the outside surface of the closed halves developing a circle, the halves 2*a* and 3*a* are formed so as to produce an elipse, when closed. This provides more of a wave to the hair than the circular shaped curler. Other shapes of the outside surface may be selected for the desired effect on the hair, but in all cases the halves are separated by the serpentine parting line between the halves.

I claim:

1. An elongated hair curling roller comprising in combination:

a pair of openable mating jaws having a pivotal hinge axis and wherein each of the jaws has a sinuous shaped interfacing surface reciprocally related to the other jaw taken in a cross-section parallel to the hinge axis, and further comprising cooperatively contoured outside surfaces forming a closed plane curve in similar cross-section.

2. The combination of claim 1 wherein each of said jaws is provided with a longitudinally oriented bore therethrough and further including a plurality of laterally disposed apertures communicating between said bore and the contoured surface of the jaw.

3. The combination of claim 1 wherein the sinuous interfacing surfaces are substantially tangent to the contoured surface along their lines of intersection.

4. The combination of claim 1 and further including:

rim means disposed at each end of said roller; and fastener means comprising a pair of end rings interconnected by an elastic band wherein the end rings are adapted to be mounted on the respective rim means.

* * * * *